US010450776B2

(12) United States Patent
McMillan et al.

(10) Patent No.: US 10,450,776 B2
(45) Date of Patent: Oct. 22, 2019

(54) LOW POWER MAGNETIC LOCK ASSEMBLY

(71) Applicant: RUTHERFORD CONTROLS INT'L INC., Cambridge (CA)

(72) Inventors: Ryan McMillan, Elmira (CA); Soo Jeon, Waterloo (CA); Vahid Babakeshizadeh, Toronto (CA)

(73) Assignee: Rutherford Controls Int'l Inc., Ontario (CA)

( * ) Notice: Subject to any disclaimer, the term of this patent is extended or adjusted under 35 U.S.C. 154(b) by 623 days.

(21) Appl. No.: 14/781,822

(22) PCT Filed: Apr. 4, 2014

(86) PCT No.: PCT/CA2014/050347
§ 371 (c)(1),
(2) Date: Oct. 1, 2015

(87) PCT Pub. No.: WO2014/161093
PCT Pub. Date: Oct. 9, 2014

(65) Prior Publication Data

US 2016/0047144 A1 Feb. 18, 2016

Related U.S. Application Data

(60) Provisional application No. 61/808,923, filed on Apr. 5, 2013.

(51) Int. Cl.
*E05B 47/00* (2006.01)
*E05C 19/16* (2006.01)

(52) U.S. Cl.
CPC ..... *E05B 47/0002* (2013.01); *E05C 19/166* (2013.01); *E05B 2047/0054* (2013.01);
(Continued)

(58) Field of Classification Search
CPC .. Y10T 292/11; Y10T 70/7057; E05C 19/166; E05C 17/56; E05C 19/16; E05C 19/168; E05B 47/0002; E05B 2047/0086
(Continued)

(56) References Cited

U.S. PATENT DOCUMENTS 4,703,962 A * 11/1987 Kelly ..... E05B 65/108 292/251.5
4,848,115 A 7/1989 Clarkson et al.
(Continued)

OTHER PUBLICATIONS

International Search Report (ISR) (PCT Form PCT/ISA/210) dated Jul. 2, 2014, in PCT/CA2014/050347.

*Primary Examiner* — Mark A Williams
(74) *Attorney, Agent, or Firm* — Baker & Hostetler LLP

(57) ABSTRACT

An electromagnetic lock assembly includes a magnet block having a coil assembly and a connection for receiving an electrical current; and a control system having a detection circuit and an activation circuit, wherein the detection circuit senses a voltage across the coil and automatically sends an activation signal to the activation circuit when the voltage decreases from a supply voltage to a reference threshold voltage, the activation circuit increasing the electrical current through or the voltage across the coil assembly upon receipt of the activation signal. The electromagnetic lock assembly may further include an armature for coupling with the magnet block, wherein the supply voltage is configured by the control system to magnetically couple the armature and the magnet block absent an external separating force applied against the armature or magnet block.

12 Claims, 7 Drawing Sheets

(52) U.S. Cl.
CPC ..... *E05B 2047/0056* (2013.01); *E05B 2047/0066* (2013.01); *E05B 2047/0071* (2013.01); *E05B 2047/0072* (2013.01); *E05B 2047/0089* (2013.01); *E05B 2047/0097* (2013.01)

(58) Field of Classification Search
USPC ..... 292/251.5
See application file for complete search history.

(56) References Cited

U.S. PATENT DOCUMENTS 5,184,855 A * 2/1993 Waltz ..... E05C 19/168 292/251.5
5,479,151 A * 12/1995 Lavelle ..... E05B 65/108 292/251.5
5,516,166 A * 5/1996 Frolov ..... E05C 19/166 292/251.5
6,007,119 A * 12/1999 Roth ..... E05C 19/166 292/251.5
6,609,738 B1 * 8/2003 Roth ..... E05B 65/108 292/144
2003/0164614 A1 * 9/2003 Fly ..... E05B 17/2084 292/25
2008/0094158 A1 * 4/2008 Schmid ..... E05C 19/166 335/291
2011/0018680 A1 1/2011 Lai et al.
2013/0168976 A1 * 7/2013 Liao ..... E05C 19/166 292/251.5
2013/0229020 A1 * 9/2013 Liao ..... E05C 19/166 292/251.5
2014/0159388 A1 * 6/2014 Liao ..... E05C 19/166 292/251.5
2015/0267442 A1 * 9/2015 Zhang ..... E05B 15/0086 292/139

* cited by examiner

LOW POWER MAGNETIC LOCK ASSEMBLY

FIELD OF THE INVENTION

The present invention relates to door locking mechanisms, more particularly to a low power electromagnetic lock assembly.

BACKGROUND OF THE INVENTION

Compared to conventional locks, electromagnetic locks are, in general, easy to install, quick to operate and sturdy. Due to the capability of fully electronic operation, electromagnetic locks are almost always part of a complete electronic access control system. One potential issue arising from the operation of electromagnetic locks is that they require continuous power to remain locked. Although their power consumption may be typically less than that of conventional light bulbs, the power loss can be significant in the longer term, particularly if there is a need to keep the door in a locked state. Maintaining an electromagnetic lock in the locked state using full power can be especially inefficient in cases where no one really tries to enter or exit the door most of the time.

Conventional electromagnetic locks consist of magnetic wire wrapped around a bobbin which is placed within magnetic laminations. Once electric power is applied, a magnetic force is generated that provides a set holding force and consumes full power at all times. This constant use of full power means that energy is wasted, which goes against the trend of employing energy-saving, or "green," devices and methods.

A more energy-efficient electromagnetic lock is required that incorporates low-cost sensing techniques to detect a force initiated to open the door. Equipped with such a sensing capability, electromagnetic locks may be operated so that the full power is applied only when an attempt is made to gain entry through the door. The magnetic locks may thus be operated with a very low effective holding strength, drawing very little current, when no force is being applied to open the door, thereby enhancing significantly the energy-efficiency and related operational costs of these devices.

SUMMARY OF THE INVENTION

Embodiments of the present invention advantageously provide a low power electromagnetic lock assembly. The electromagnetic lock assembly in accordance with aspects of the present invention includes a magnetic block, an armature, a detection circuit to detect abrupt voltage changes in a magnetic coil when the magnetic block separates from the armature so that the assembly may be maintained in a low power steady state until the detection circuit detects a voltage change and activates an activation circuit to increase the current to the coil (voltage across the coil).

There has thus been outlined, rather broadly, certain embodiments of the invention in order that the detailed description thereof may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and constitute a part of this specification, illustrate various embodiments consistent with the invention, and, together with the description, serve to explain the principles of the invention.

DETAILED DESCRIPTION

Figure 1:
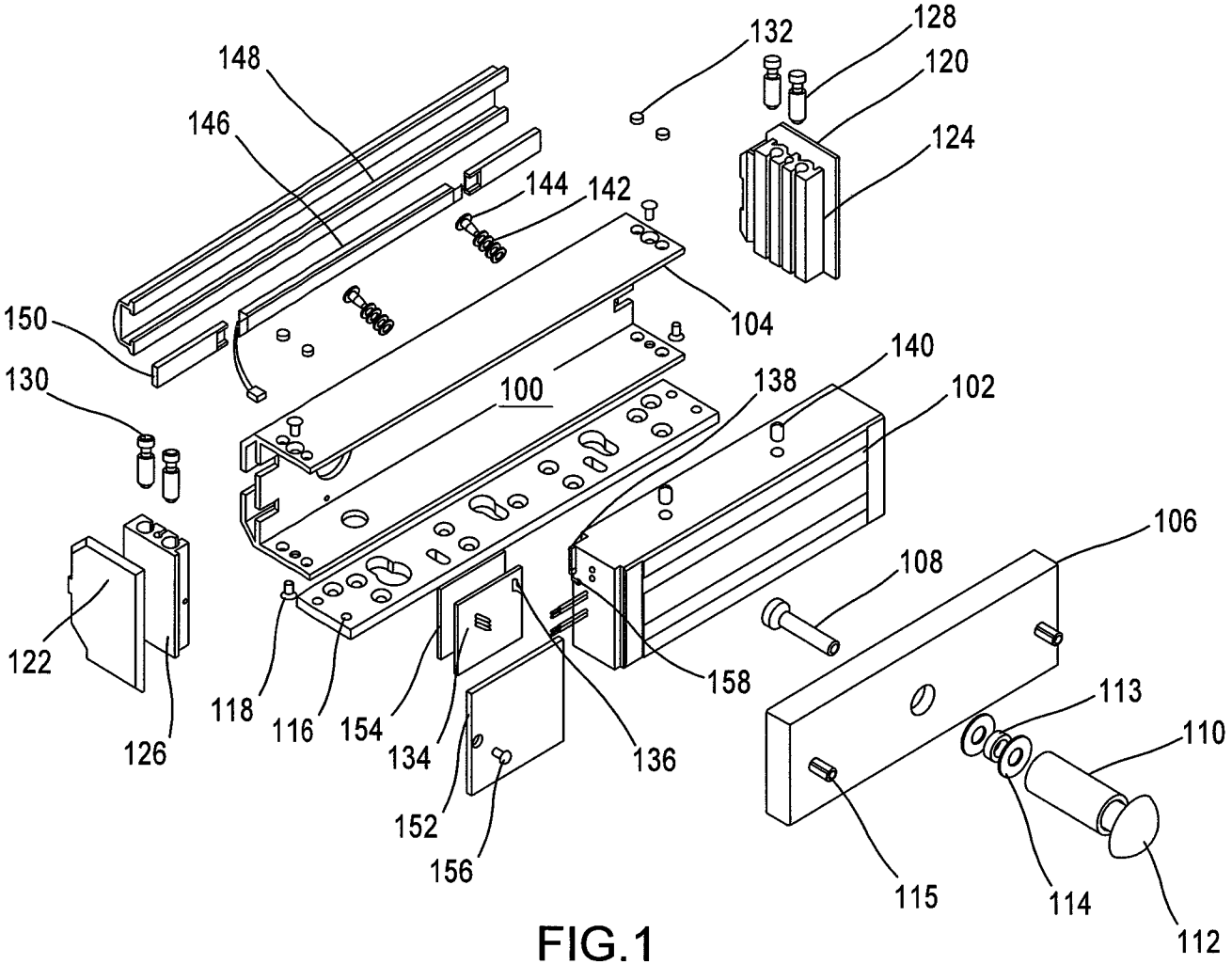
FIG. 1 is an exploded view showing the component parts of an electromagnetic lock assembly, in accordance with certain aspects of the present invention.

The invention will now be described with reference to the drawing figures, in which like reference numerals refer to like parts throughout.

Various aspects of an electromagnetic lock assembly may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of aspects of an electromagnetic lock assembly in addition to the orientation depicted in the drawings. By way of example, if aspects of an electromagnetic lock assembly shown in the drawings are turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of an electromagnetic lock assembly may be illustrated with reference to one or more exemplary embodiments. As used herein, the term "exemplary" means "serving as an example, instance, or illustration," and should not necessarily be construed as preferred or advantageous over other embodiments of an electric strike assembly disclosed herein.

As depicted in FIG. 1, in accordance with aspects of the present invention, an electromagnetic lock assembly 100 includes a magnet block 102 housed in a housing 104. The magnet block 102 couples to an armature plate 106 that is secured to a door (not shown), using appropriate hardware such as an armature plate center bolt 108, a tubing assembly 110 (e.g., aluminum), a nut 112, a washer 113 (e.g., rubber), a flat washer 114, and one or more armature plate pins 115, for example.

In one embodiment, the electromagnetic lock assembly 100 may be mechanically enclosed and secured to the door frame using a mounting plate 116, along with other hardware. The housing 104 could incorporate supporting accessories, such as a right housing end cover 120, a left end cover 122, a right inner housing end 124, left inner and outer housing ends 126, a fitting 128 (e.g., brass), an Allen cap screw 130, and a filler cap 132. Fitting 128 and screw 130 may secure the lock to the mounting plate 116; and countersink screws 118 may secure the endplates to the housing.

A printed circuit board (PCB) 134 generally controls electrical power provided to the magnet block 102, and includes at least one controller chip, control circuit, etc. PCB 134 also performs other functions in various embodiments. For example, PCB 134 may manipulate or convert the input voltage to the desired output voltage, such as from 24 VDC to 12 VDC, from 12 VAC to 12 VDC, etc. PCB 134 may provide one or more system status signals to alarm, indicator or security systems. PCB 134 may accept control signals, such as, for example, an exit request signal, a mode select signal, etc. PCB 134 may also sense the holding force requirements, and provide the proper voltage. Other functions are also contemplated by the present invention.

A sensor, such as, for example, a microswitch 136, may be coupled to PCB 134 to detect a force or condition applied to the door in accordance with aspects of the present invention. The microswitch 136 may be secured using a switch bracket 138. In order to accommodate the slight motion required for the microswitch 136 to detect any possible threatening external force on the door, a tension bearing assembly 140 may be used to allow the magnet block 102 to slightly change its internal position relative to the housing 104 and the door frame (not shown). This movement may be supported by hardware such as one or more spring washers 142, and one or more truss screws 144, for example.

Figure 2:
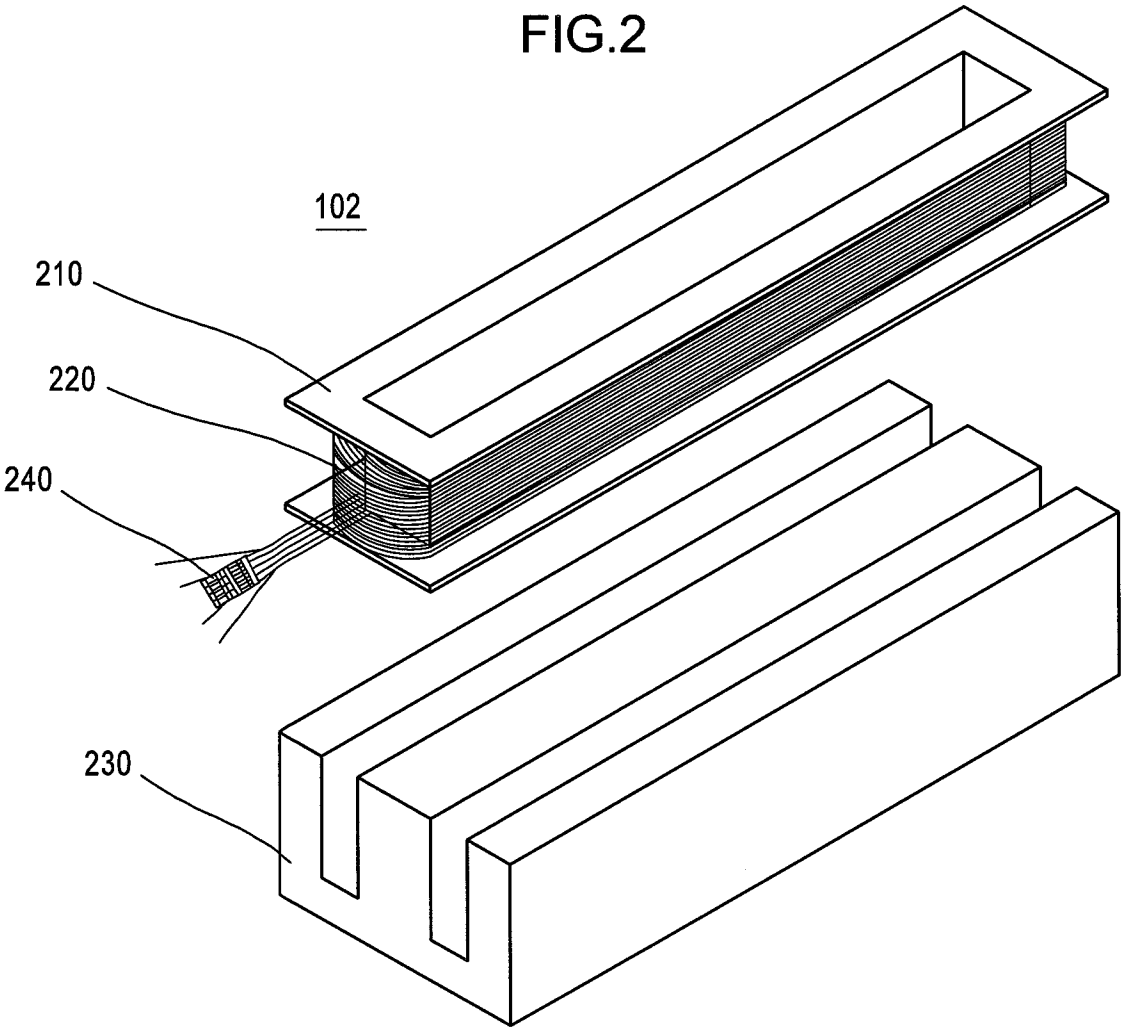
FIG. 2 is a perspective exploded view showing components of a magnetic block, in accordance with certain aspects of the present invention.

As depicted in FIG. 2, the magnet block 102 may include a bobbin 210 that secures a coil 220, both housed within an E-plate 230. The coil 220 may include a plug 240 that accommodates the appropriate electrical connections for receiving electrical power. This arrangement advantageously allows the coil 220 to accept electrical energy from the plug 240, creating a magnetic field that mechanically joins the E-plate 230 to the armature plate 106. The PCB 134 provides electrical stimulation to the plug 240, causing the coil 220 to produce a magnetic field of specified strength, which may be categorized, for example, into a high or a low strength magnetic field.

As described above, embodiments of the present invention may generate at least two levels of holding force or strength settings. This may be accomplished, for example, by having two coils 220 wrapped around one bobbin 210, or by a low and a high voltage setting to coil 220. In one embodiment, the low strength setting is the default and only maintains the door in the closed position. Should the door be subjected to a pressure above a preset force, the electromagnetic lock 100 automatically switches to the high strength setting. Once the pressure is released the lock 100 then returns to the low strength setting.

Other embodiments are also contemplated by the present invention. For example, three or more coils 220 may be wrapped around bobbin 210 to provide three or more discrete strength levels. Similarly, three or more different voltage levels may be applied to coil 220 to provide three or more strength levels. Of course, multiple coils 220 (c) may be combined with multiple voltage levels (v) to provide many different strength levels (c×v). Additionally, a single voltage may accommodate different waveforms to provide different strength levels.

When the door is closed and locked, PCB 134 may initially set the electromagnetic lock assembly 100 to a low strength setting that uses a low strength magnetic field to secure the door, which consumes less power than known electromagnetic locks of similar size. In order to prevent persons or other conditions, such as wind, for example, from overcoming the holding strength provided by the electromagnetic lock assembly 100 when set to the low strength setting, the force or condition must be first detected, and then PCB 134 sets the electromagnetic lock assembly 100 to a higher strength setting that uses a high strength magnetic field to secure the door. The high strength setting consumes more power than the low strength setting, but may consume less, the same or more power than known electromagnetic locks of similar size. In a preferred embodiment, PCB 134 sets the DC voltage provided to magnet block 102 to control the magnetic field strength; other variations are also contemplated. Intermediate strength settings are also contemplated by the present invention. For example, a medium strength setting(s) may be used in place of the low and/or high strength settings, and consumes more power than the low strength setting and less power than the high strength setting.

The detection of a force applied on the door may be performed by one or more alternative sensors. Conventional systems may rely on a proximity sensor, for example, or a contact sensor that detects some type of physical access to the door. Other methods of access detection may include installing a commercial CCD (charge-coupled device) camera for surveillance of the surrounding area. However, such methods require a stand-alone sensing module that is separate from and an additional component to the magnetic lock assembly.

In accordance with aspects of the present invention, the electromagnetic lock assembly 100 is configured to measure the magnetic reluctance of the electromagnet to detect an initial opening force applied to the door. The solenoid coil 220 of the electromagnet lock assembly is used as a self-sensing medium, wherein a change in the voltage (or current) over (or through) the actuating coil 220 is detected as the armature plate 106 moves. The detection of this parameter change may then be used to initiate the required control signal to increase the power to the magnetic lock assembly 100 in order to hold the door shut in a locked state.

A holding strength of the coupled magnet block 102 and the armature plate 106 must be higher than a maximum force that can be exerted by a person applying full force against the door, which can be generally in the range of about 500 N. By monitoring the voltage over the coil 220, the electromagnetic lock assembly 100 of the present invention may be configured to sense an instantaneous change or spike in the voltage that signals a separating force has been applied to the door, wherein the PCB 134 may then be configured to increase power to the magnet block 102 in order to strengthen the holding force to more than the maximum force.

To illustrate various concepts related to aspects of the present invention, Table 1 below shows a set of parameters and associated values for an exemplary electromagnetic lock assembly 100.

TABLE 1

Parameter Values

| Property | Notation | Value |
|---|---|---|
| Mass of Armature | m | 1.5 kg |
| Number of Windings around the Core | N | 870 |
| Electrical Resistance of the Coil | R | 54.5 Ω |
| External Force | Fext | 50-500 N |
| Supply Voltage in the Stand-by mode | V stand-by | .5 V |
| Reluctance of the Core | R | 3.4669e004 H − 1 |
| Equivalent Length of the Core | l | 7.1128e−005 m |
| Equivalent Cross-Section of the Core | Aeq | 0.0016 m2 |

During the low power state, when the door simply needs to maintained in a closed position and no force is being applied against the door, the supply voltage to the coil 220 is held at a minimum value required for sensing. For example, the initial value of the current in in the stand-by mode may be Vcoil=0.5 V. In the stand-by mode, the armature 106 is magnetically coupled to the coil 220, i.e. x=0 m and the electromagnetic assembly 100 is assumed to be in a still state, i.e. x=0 m at t=0 ms.

An external force of magnitude Fext=500 N may be applied as a step input to the armature 106 at t=1 ms by which time the magnetic force has reached a steady state value. The governing equations for analyzing the effect of the external force on the door are as follows:

$$\frac{di}{dt} = \frac{l+x}{\mu_0 A_{eq} N^2}\left(V - Ri + \frac{\mu_0 A_{eq} N^2}{(l+x)^2}\dot{x}i\right) \tag{1}$$

-continued $$m\ddot{x} = F_{ext} - \frac{1}{2}\frac{\mu_0 A_{eq} N^2}{(l+x)^2} i^2 \tag{2}$$

The symbol $u_0$ denotes the magnetic constant ($4\pi\times10^{-7}$ H/m). Assuming that the current to the coil 220 remains constant during an initial movement of the armature 106, equation (1) reduces to:

$$V = Ri - \frac{\mu_0 A_{eq} N^2}{(l+x)^2}\dot{x}i \tag{3}$$

Equation (2) provides the position of the armature 106 as a function of time and the voltage over the coil 220 may be determined using equation (3).

Figure 3:
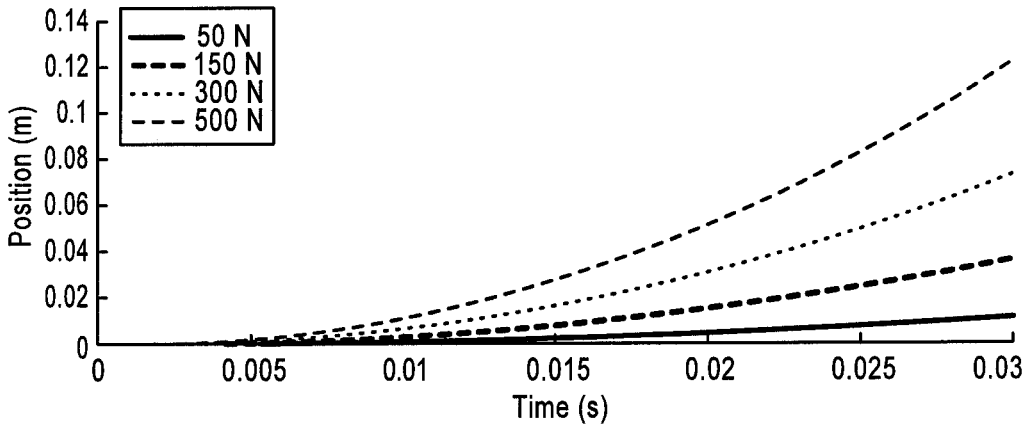
FIG. 3 is a graph illustrating the position of an armature over time for various levels of force applied to a door, in accordance with certain aspects of the present invention.
Figure 4:
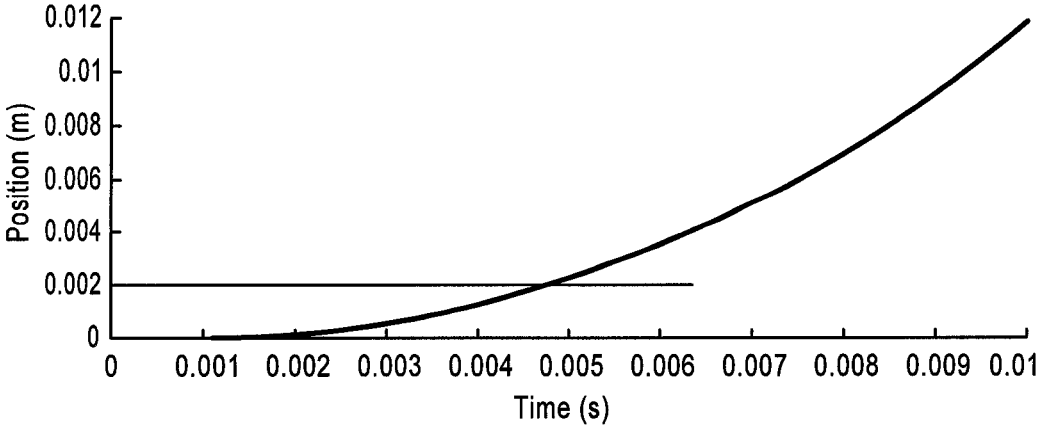
FIG. 4 is a graph illustrating the position of an armature over time for a specific level of force applied to a door, in accordance with certain aspects of the present invention.

FIG. 3 is a graph illustrating the position of the armature 106 as it moves away from the magnet block 102 over time when forces of varying degrees are applied against the door. As the applied force is increased, the rate at which the armature 106 moves away also increases. At a distance of about 2 mm separation, the magnetic force between the magnet block 102 and the armature 106 almost vanishes. As shown in FIG. 4, which is an isolation view of a 500 N curve, the air gap between the magnet block 102 and the armature 106 reaches 2 mm at around t=5 ms for a $F_{ext}$=500 N, which is 4 ms after the external force is applied.

Figure 5:
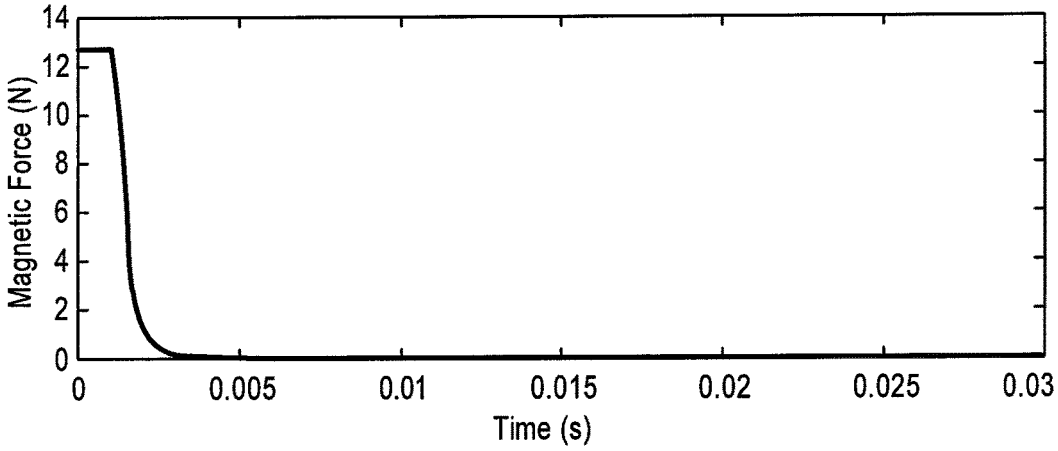
FIG. 5 is a graph illustrating the magnetic force over time for a specific level of force applied to a door, in accordance with certain aspects of the present invention.
Figure 6:
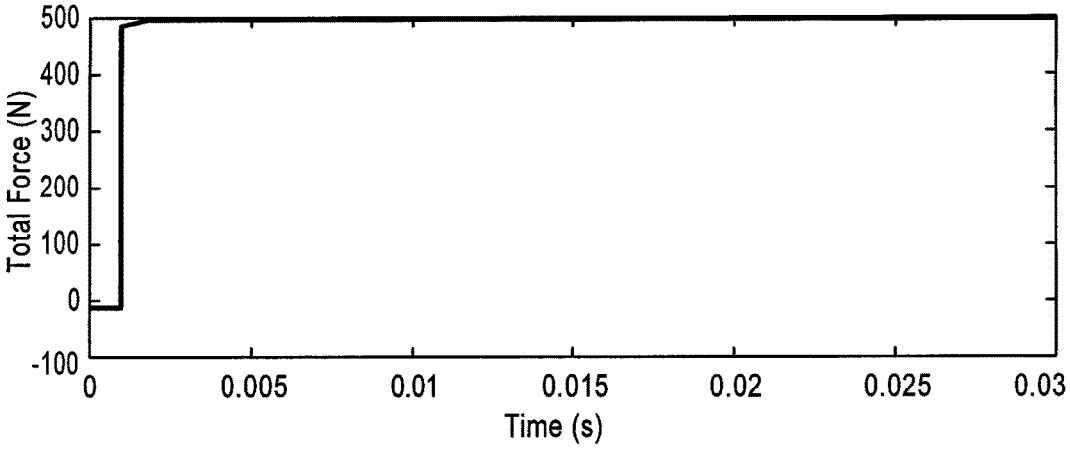
FIG. 6 is a graph illustrating the total force on the armature over time for a specific level of force applied to a door, in accordance with certain aspects of the present invention.

The magnetic force over time is illustrated in FIG. 5 and the total force applied to the armature 106, which is the combination of the magnetic force plus the external force, is illustrated in FIG. 6. At t=1 ms, there is an abrupt change in the value of the total force from the stand-by mode value to 500 N.

Figure 7:
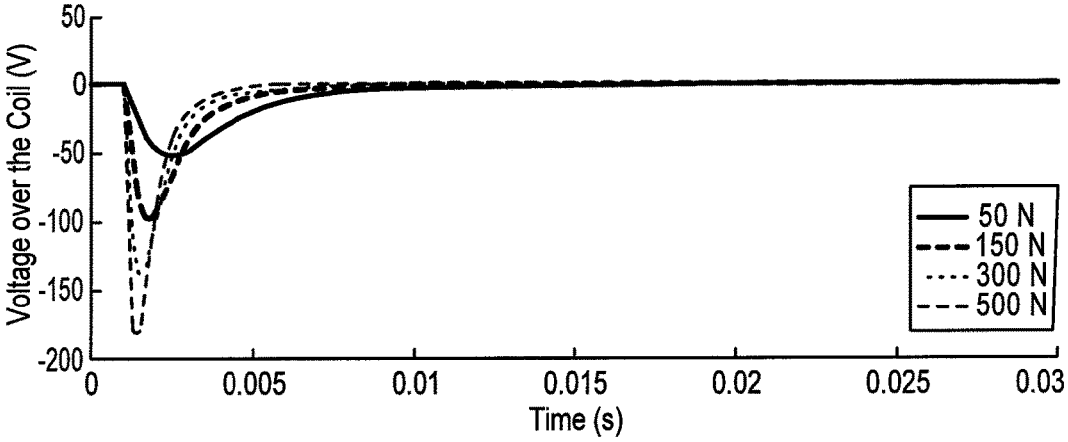
FIG. 7 is a graph illustrating the voltage over a coil over time for various levels of force applied to a door, in accordance with certain aspects of the present invention.
Figure 8:
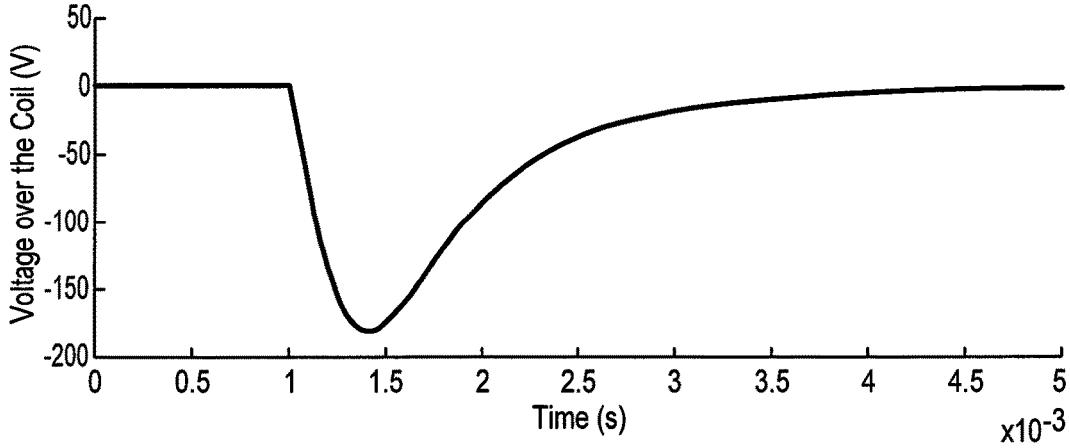
FIG. 8 is a graph illustrating the voltage over a coil over time for a specific level of force applied to a door, in accordance with certain aspects of the present invention.

FIG. 7 illustrates the change in voltage over the coil 220 over time for the selected external forces, which is determined using equation (3) above. As shown in FIG. 8, which is an isolation view of the 500 N curve, the voltage over the coil drops substantially at t=1 ms with application of a force to the door. The electromagnetic lock assembly 100 in accordance with aspects of the present invention is configured to sense the change in voltage over the coil 220. Upon sensing a change such as that shown in FIGS. 7 and 8, a signal may be sent to the PCB 134 to increase power to the magnet block 102 in order to increase the strength of the magnetic force. Thus, the holding strength is increased to prevent any further separation of the armature 106 from the magnet block 102 prior to the armature leaving the effective region of the electromagnetic system at approximately 2 mm and force. The armature 106 may be forced back to the zero position of being in direct contact with and adjacent to the magnet block 102.

In accordance with aspects of the present invention, a control system may include a detection circuit configured into the electromagnetic lock assembly 100 for sensing the detachment of the armature 106 accompanied by an activation circuit, which may be a voltage amplifier circuit, the activation circuit being activated by the detection circuit.

Magnetic force increases twice as fast as the current passing through the coil 220. By holding a small voltage that satisfies the sensing requirements of the system while in stand-by mode, the energy consumption will decrease significantly as the power has a quadratic relation with the supply voltage. The magnetic force maintained in the stand-by mode is enough to keep the door closed but insufficient to resist keeping it closed external forces are applied. When the detection circuit senses a voltage decrease across the coil 220, the activation circuit is automatically activated to apply the required voltage for producing a magnetic force strong enough to oppose the external force. The activation circuit produces a high voltage across the coil 220 for a short period of time when the detection circuit indicates that the armature 106 has moved away from the magnet block 102. The activation circuit is activated well before the armature 106 moves toward the 2 mm threshold for maintaining the magnetic connection. After this short period of time, the supply voltage may be reduced to the stand-by mode voltage once again.

Figure 9:
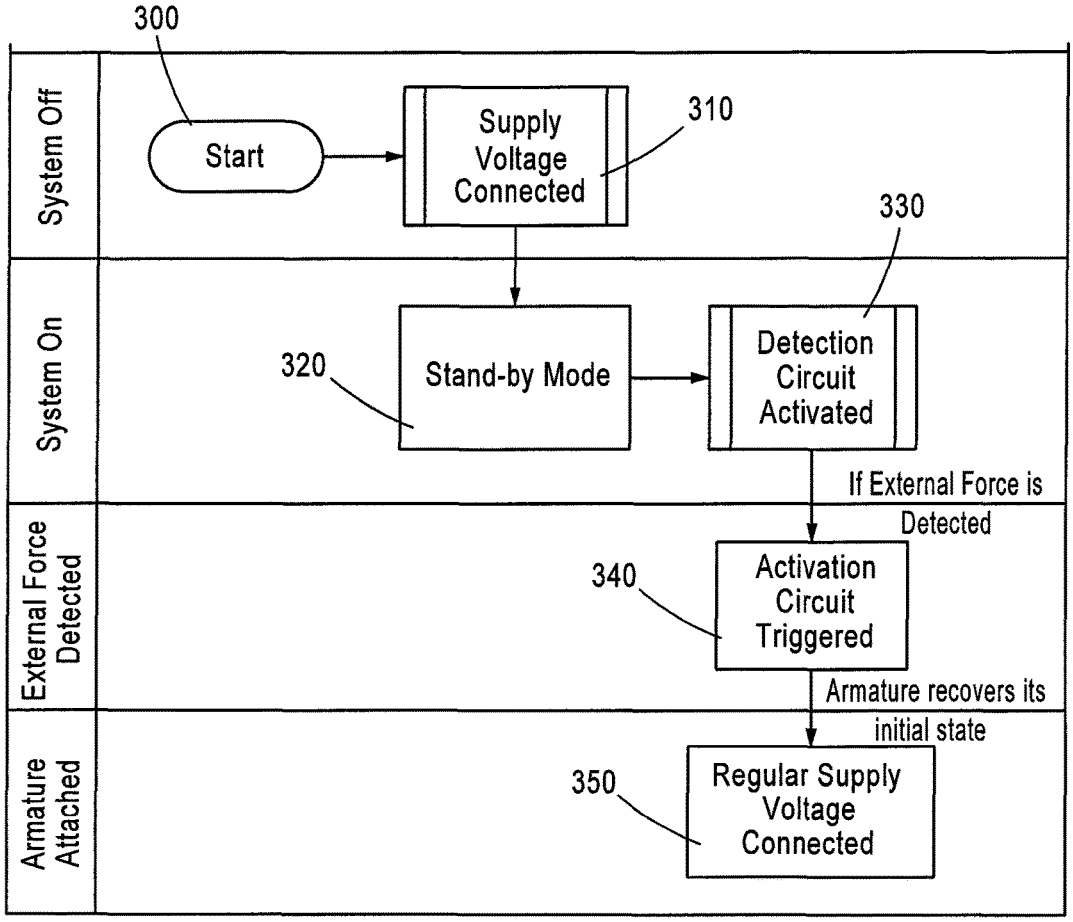
FIG. 9 is a process flow for a control system for an electromagnetic lock assembly, in accordance with certain aspects of the present invention.

FIG. 9 illustrates a control process in accordance with aspects of the present invention. The process starts at step 300 with the system disconnected and non-operational. A supply voltage may be connected to the electromagnetic lock assembly 100 at step 310 and the system activated. As illustrated at 320, the assembly is initially in a stand-by mode in which a steady low power threshold voltage is maintained.

Figure 10:
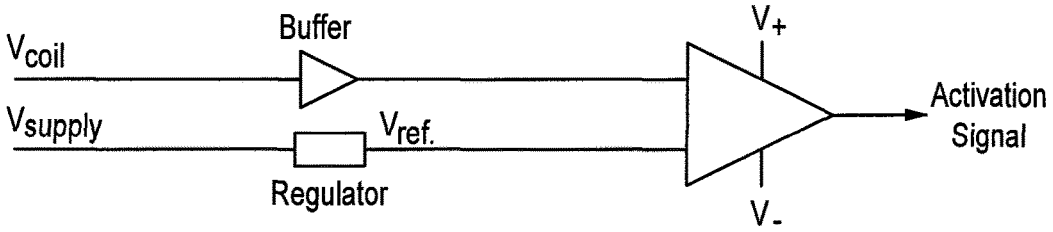
FIG. 10 is a schematic of a detection circuit, in accordance with certain aspects of the present invention.
Figure 11:
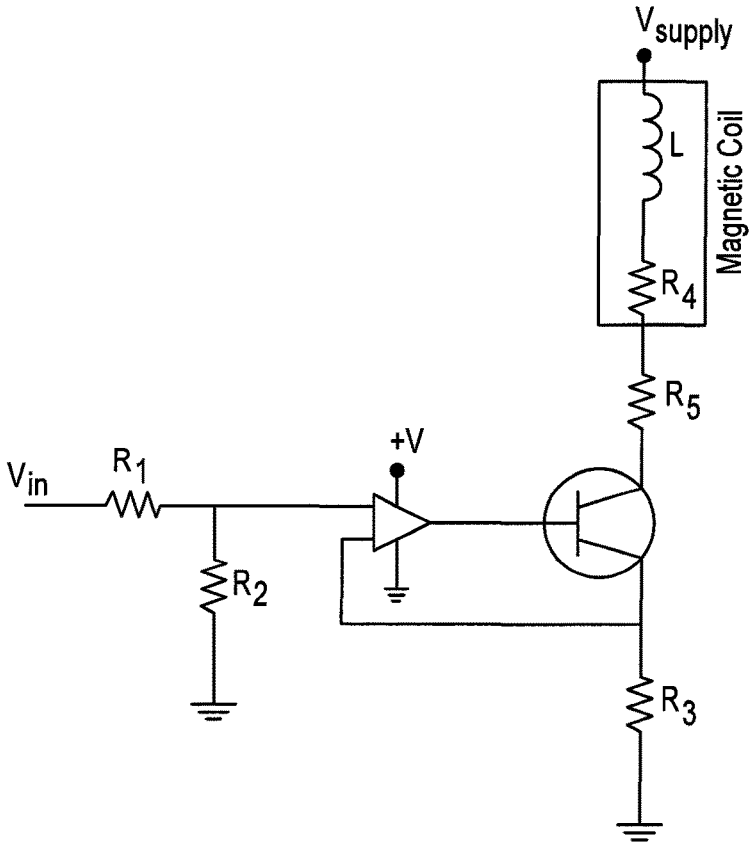
FIG. 11 is a schematic of an activation circuit, in accordance with certain aspects of the present invention.

The detection circuit may be activated at step 330. The main process in the detection circuit is to determine when the voltage over the coil 220 changes abruptly and crosses a threshold value. A schematic of a detection circuit in accordance with aspects of the present invention is shown in FIG. 10. The detection circuit may perform as a comparator op-amp that produces an activation signal if the voltage over the coil decreases to the reference threshold voltage. Upon sensing that an external force is being applied to the door, wherein a voltage drop is recorded across the coil 220, as described above, the detection circuit triggers the activation circuit at step 340. When the activation circuit is triggered, the current through or the voltage across the coil 220 is increased to strengthen the magnetic pull exerted on the armature 106. The voltage may be increased immediately to a predetermined threshold value determined to hold the door shut, or the voltage may be iteratively increased via a feedback loop of continued or increased voltage changes as determined by the detection circuit. As shown in FIG. 11, a current amplifier circuit may be used for the activation circuit. The steady state stand-by mode current passing through the magnetic lock can be calculated using equation (4) below.

$$i = \frac{R_2}{R_3(R_1 + R_2)} V_{in} \tag{4}$$

Thus, adjusting the values of the parameters shown in the circuit in FIG. 11, the current can be set to any desirable value.

A minimum required value for the voltage to be provided by the amplifier circuit may be determined to prevent the armature 106 from separating beyond the critical 2 mm distance. The distance between the armature 106 and the coil 220 before the activation phase can be calculated by equation (5).

$$x(t)=\tfrac{1}{2}a_d t^2 \tag{5}$$

where $a_d$ is the acceleration of the armature 106 and where $a_d=F_h/m$, $F_h$ being the detaching force applied to the armature 106 and m is the armature's mass. After the amplifier circuit is activated, the cumulative force applied to the armature will be the interaction of the external force and the magnetic force. Therefore, the following equation (6) for the acceleration of the armature holds:

$$a_a = \frac{F_h - F_m}{m} \tag{6}$$

where $a_a$ is the acceleration after activation and $F_m$ is the magnetic force. Equation (6) is derived supposing that the magnetic and external forces remain constant after activation. Since the magnetic force depend on the distance between the armature 106 and the magnet block 102, a reasonable value for the distance is considered with a confidence interval.

The distance of the armature after activation may be determined based on equation (7) below:

$$x(t)=\tfrac{1}{2}a_a(t-t_a)^2+a_d t_a(t-t_a)+x_a \tag{7}$$

where $t_a$ is the activation time, and $x_a$ is the air gap at $t_a$. Thus, the distance of the armature is:

$$x_a=\tfrac{1}{2}a_d t_a^2 \tag{8}$$

Since $a_a \leq 0$, the distance diagram has a maximum that occurs at $t=t_a(1-a_d/a_a)$ and is equal to:

$$x_{max} = \frac{1}{2}a_d t_a^2\left(1 - \frac{a_d}{a_a}\right) = \frac{1}{2mm}\left(\frac{F_h F_m}{F_m - F_h}\right)t_a^2 \tag{9}$$

Knowing that the maximum distance is 2 mm, various values of $t_a$ and $F_m$ can be determined accompanied by a required current to produce the magnetic force.

To calculate the required current, an average position of 0.5 mm may be considered, for example. Also, $t_a$ may be interpreted as the time when the current through the coil 220 reaches the required value regarding the inducing behavior of the system. Furthermore, considering the coil 220 simply as an RL circuit, the time constant of the circuit becomes:

$$\tau = \frac{L}{R_4 + R_5} = \frac{L}{R_t} \tag{10}$$

where R4 is the electrical resistance of the coil 220, and R5 is the electrical resistance corresponding to the other elements in the circuit shown in FIG. 11. The maximum time constant may be determined when the armature 106 is attached to the coil 220 according to equation (11) below:

$$\tau_{max} = \frac{L_{max}}{R_t} = \frac{\mu_0 A_{eq} N^2}{R_t l} \approx 0.0386 \text{ s} \tag{11}$$

With the detection circuit acting without delay, the required steady state currents may be determined that result in the needed currents to produce the magnetic force (calculated above in equation (9)) within the specified time of $t_a$, as follows:

$$i(t) = i_{ss}\left(1 - e^{-\frac{t}{\tau}}\right) \rightarrow i_{ss} = \frac{i(t)}{1 - e^{-\frac{t}{\tau}}} \tag{12}$$

With the steady state currents determined above, the corresponding supply voltages may be determined to produce the necessary magnetic force within the specified time to avoid the gap exceeding 2 mm. After the increased voltage is activated by the activation circuit, the armature may regain its original position, for example, in less than 20 ms. Once the armature 106 is attached to the magnet block 102, the supply voltage may be reduced to the normal supply voltage.

In accordance with aspects of the present invention, the control system, which may be integrated into the PCB 134, may employ a self-teaching or self-adjusting mode. There are often situations in which a door may be subject to an applied pressure which is not the result of a person trying to gain entry. For example, pressure differentials in a substantially sealed home or building caused by wind or the activation/deactivation of heating, ventilation, and air-conditioning (HVAC) systems may trigger a door to experience a pressure event several times daily, or even hourly. If the air pressure change experienced by the door is such that it continually triggers the detection circuit to activate the activation circuit, a full holding current may be applied to the electromagnetic lock assembly 100 with such frequency that the intended power savings of the assembly 100 may not be effectively realized. In this case, the control system of the electromagnetic lock assembly 100 may intelligently and/or systematically increase or decrease, for example, the steady low power threshold voltage to a level just above the holding power necessary to avoid triggering the detection circuit when the air pressure changes as a result of an environmental pressure differential. In accordance with yet other aspects of the present invention, the system may algorithmically determine an efficiency threshold, for example, wherein the consumption of energy to maintain a higher minimum threshold voltage is equal to or less than the energy consumption that is the result of periodically triggering the activation circuit by virtue of the threshold voltage being set at a lower value, for a given period of time. Similarly, if the detection circuit is infrequently activating the activation circuit, the minimum threshold voltage may be set too high. In this case, the system may self-adjust to a lower minimum threshold voltage and observe the impact on the number of times that the detection system is activated, for example, over a given period of time. A feedback loop of control data may permit continuous fine-tuning of the system to account for the variability in seasons, for example, or many other factors that may necessitate a change to the minimum threshold voltage in order to run the electromagnetic lock assembly 100 most cost efficiently. In accordance with other aspects of the present invention, the control system may also be manually controlled or programmed to operate at certain predetermined thresholds.

In accordance with yet other aspects of the present invention, the electromagnetic lock assembly 100 may include a status alarm, wherein measurement of the voltage in accordance with the methods described above indicates that the door remains open beyond a predetermined time threshold, for example, or remains closed, even though the system has been activated to allow the door to open.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. An electromagnetic lock assembly comprising:

a magnet block configured to be secured to a door frame, the magnet block having a coil assembly and a connection for receiving an electrical current;

an armature plate configured to be secured to a door, the armature plate being coupled to the magnet block when the armature plate is within a magnetic field of the magnet block; and a control system having a detection circuit and an activation circuit, wherein:

when the detection circuit senses, based on detecting an attempted opening of the door, a change in current via a voltage spike caused by the armature plate moving away from the magnet block, the detection circuit triggers an activation signal to the activation circuit, causing the activation circuit to increase the electrical current through or voltage across the coil assembly upon receipt of the activation signal, thereby increasing an allowable external force required to open the door to an amount to prevent the door from opening.

2. The electromagnetic lock assembly of claim 1, wherein the detection circuit is a comparator op-amp.

3. The electromagnetic lock assembly of claim 1, wherein the activation circuit is a voltage amplifier circuit.

4. The electromagnetic lock assembly of claim 1, wherein a supply voltage is configured by the control system to magnetically couple the armature plate and the magnet block absent an external separating force applied against the armature or magnet block.

5. The electromagnetic lock assembly of claim 4, wherein the activation circuit is activated prior to an air gap of 2 mm forming between the armature plate and the magnet block when the external separating force is applied.

6. The electromagnetic lock assembly of claim 5, wherein the control system controls the voltage across the coil to supply a magnetic holding force greater than the external separating force.

7. The electromagnetic lock assembly of claim 6, wherein the external separating force is 500 N.

8. The electromagnetic lock assembly of claim 6, wherein the magnetic holding force is iteratively increased via a feedback loop of continued or increased voltage changes as determined by the detection circuit.

9. The electromagnetic lock assembly of claim 6, wherein the control system includes a self-teaching mode based on a feedback loop of data for intelligently and/or systematically increasing or decreasing the supply voltage to provide a minimum magnetic holding force responsive to predetermined environmental factors.

10. The electromagnetic lock assembly of claim 4, wherein the control system is configured to accept a request signal to decrease the voltage across or current through the coils, such that the armature plate and magnetic block may separate without the activation circuit being triggered.

11. The electromagnetic lock assembly of claim 1, wherein the electromagnetic lock assembly operates in a standby-by mode at a voltage of about 0.5 V before the activation signal is triggered.

12. The electromagnetic lock assembly of claim 11, wherein the electromagnetic lock assembly operates in a powered state at a voltage exceeding 100 V after the activation signal is triggered.

* * * * *